US011539140B2

(12) United States Patent
Marnat et al.

(10) Patent No.: US 11,539,140 B2
(45) Date of Patent: Dec. 27, 2022

(54) COMPACT RESONANT CAVITY ANTENNA

(71) Applicant: Commissariat a l'Energie Atomique et aux Energies Alternatives, Paris (FR)

(72) Inventors: Loïc Marnat, Grenoble (FR); Antonio Clemente, Grenoble (FR)

(73) Assignee: Commissariat a l'Energie Atomique et aux Energies Alternatives, Paris (FR)

( * ) Notice: Subject to any disclaimer, the term of this patent is extended or adjusted under 35 U.S.C. 154(b) by 42 days.

(21) Appl. No.: 17/124,836

(22) Filed: Dec. 17, 2020

(65) Prior Publication Data

US 2021/0194142 A1 Jun. 24, 2021

(30) Foreign Application Priority Data

Dec. 18, 2019 (FR) ..... 19 14717

(51) Int. Cl.
*H01Q 13/18* (2006.01)
*H01Q 15/08* (2006.01)
*H01Q 19/185* (2006.01)

(52) U.S. Cl.
CPC ..... *H01Q 13/18* (2013.01); *H01Q 15/08* (2013.01); *H01Q 19/185* (2013.01)

(58) Field of Classification Search
CPC .... H01Q 13/18; H01Q 15/08; H01Q 15/0086; H01Q 19/185
See application file for complete search history.

(56) References Cited

U.S. PATENT DOCUMENTS 5,010,351 A 4/1991 Kelly
8,743,003 B2 * 6/2014 De Lustrac ..... H01Q 15/0086 343/846
10,103,445 B1 * 10/2018 Gregoire ..... H01Q 21/08
(Continued)

OTHER PUBLICATIONS

French Preliminary Search Report dated Sep. 17, 2020 in French Application 19 14717 filed Dec. 18, 2019 (with English Translation of Categories of Cited Documents and Written Opinion), 15 pages.
(Continued)

*Primary Examiner* — Andrea Lindgren Baltzell
*Assistant Examiner* — Amal Patel
(74) *Attorney, Agent, or Firm* — Oblon, McClelland, Maier & Neustadt, L.L.P.

(57) ABSTRACT

A reconfigurable antenna, includes an emissive region, including at least one radiating source designed to emit electromagnetic waves; and an electromagnetic lens, including a set of phase-shifting cells, including switches configured to introduce a phase shift to the electromagnetic waves, and bias lines to bias the switches. The antenna further includes an electromagnetic coupling region, arranged between the emissive region and the electromagnetic lens in order to generate electromagnetic coupling between the electromagnetic waves and the set of phase-shifting cells, wherein the electromagnetic coupling region comprises a set of electrically conductive elements, arranged to form a contour of a resonant cavity guiding the electromagnetic waves towards the electromagnetic lens, the set of electrically conductive elements comprising first tracks electrically connected to the bias lines.

15 Claims, 4 Drawing Sheets

(56) References Cited

U.S. PATENT DOCUMENTS

| | | | | |
|---|---|---|---|---|
| 2008/0042917 | A1* | 2/2008 | Seki | H01Q 19/17 343/837 |
| 2017/0033462 | A1 | 2/2017 | Clemente et al. | |
| 2018/0301807 | A1* | 10/2018 | Clemente | H01Q 3/34 |

OTHER PUBLICATIONS

Jouanlanne, C. et al., "Wideband Linearly Polarized Transmitarray Antenna for 60 GHz Backhauling," IEEE Transactions on Antennas and Propagation, vol. 65, No. 3, Mar. 2017, XP055727552, 6 pages.

Nicholls, J. G. et al., "Full-Space Electronic Beam-Steering Transmitarray With Integrated Leaky-Wave Feed," IEEE Transactions on Antennas and Propagation, vol. 64, No. 8, Aug. 2016, XP01161844, 13 pages.

Wu, M. et al., "Reconfigurable Metasurface Lens Thin Antenna with 3-State Unit Cells in 28-GHz Band," 2019 IEEE International Symposium on Antennas and Propagation and USNC-URSI Radio Science Meeting, IEEE, Jul. 7, 2019, XP033654219, 2 pages.

Kasahara, Y. et al., "Low-Profile Transmitarray Antenna With Single Slot Source and Metasurface in 80-GHz Band," 2018 IEEE International Symposium on Antennas and Propagation and USNC-URSI National Radio Science Meeting, IEEE, Jul. 8, 2018, XP033496964, 2 pages.

* cited by examiner

COMPACT RESONANT CAVITY ANTENNA

TECHNICAL FIELD

The invention relates to the technical field of transmitarray antennas. A transmitarray antenna comprises:

- a transmitarray (also called electromagnetic lens), comprising a set of elementary cells able to be arranged in a matrix (the matrix may be regular or scattered; the regular matrix may for example comprise a square or triangular mesh);
- at least one radiating source (called primary source), designed to illuminate the transmitarray.

Each elementary cell of the transmitarray is capable of introducing a phase shift to the incident wave emitted by the primary source or sources in order to compensate each path difference of the radiation emitted between the primary source or sources and the transmitarray.

More precisely, each elementary cell of the transmitarray comprises at least:

- a first planar antenna (called receive antenna), designed to receive the incident wave emitted by the primary source or sources;
- a second planar antenna (called transmit antenna), designed to transmit, with a phase shift, the incident wave received by the first antenna.

"Planar antenna" is understood to mean an electrically conductive flat surface (normally made of metal) able to emit/receive electromagnetic radiation. One example of a planar antenna is the micro-strip patch.

Other elementary cell architectures may also be used, such as multilayer structures based on the concept of frequency-selective surfaces, or on the concept of Fabry-Perot cavities. Radiating elements such as dipoles, slots etc. may also be used in the elementary cell.

It should be noted that an elementary cell of a transmitarray is able to operate in receive mode or in transmit mode, that is to say that the first antenna of the elementary cell may also be a transmit antenna, while the second antenna of the elementary cell may also be a receive antenna.

The invention is applicable notably for obtaining a reconfigurable antenna. "Reconfigurable" is understood to mean that at least one feature of the antenna may be modified over its service life, after it has been manufactured. The feature or features generally able to be modified are the frequency response (in terms of amplitude and in terms of phase), the radiation pattern (also called beam), and the polarization. Reconfiguring the frequency response covers various functionalities, such as frequency switching, frequency tuning, bandwidth variation, phase shift, frequency filtering etc. Reconfiguring the radiation pattern covers various functionalities, such as angular scanning of the beam pointing direction (also called depointing), the aperture of the beam typically defined at half-power (that is to say the concentration of the radiation in a particular direction), spatial filtering (linked to the aperture and the formation of the beam), beamforming or multi-beamforming (for example a plurality of narrow beams replacing a wide beam) etc. A reconfigurable transmitarray antenna is particularly advantageous from the C band (4-8 GHz) up to the W band (75-110 GHz), or even the D band (110-170 GHz) or up to the 300 GHz band, for the following applications:

- automotive driving assistance and driving aid radars, from an active safety perspective,
- very-high-resolution imaging and surveillance systems,
- very-high-rate communication systems, operating notably in millimetre bands (inter-building or intra-building communications in a home automation or building automation environment, and particularly suitable for monitoring users),
- LEO (for "Low Earth Orbit") low-orbit ground-satellite telemetry links in the Ka band, satellite telecommunications with a reconfigurable primary source (SOTM™ for "Satcom-on-the-Move", Internet, television etc.),
- point-to-point and point-to-multipoint link systems (metropolitan networks, "Fronthaul" and "Backhaul" systems for cellular networks, radio access for fifth-generation mobile networks, etc.).

PRIOR ART

A transmitarray antenna known from the prior art, in particular from document WO 2012/085067, comprises:

- an emissive region, comprising a radiating source designed to emit electromagnetic waves;
- an electromagnetic lens (transmitarray), comprising:
- a set of phase-shifting cells, comprising switches configured so as to introduce a phase shift to the electromagnetic waves,
- bias lines, designed to bias the switches.

Such a transmitarray antenna has a thickness, defined by the distance (called "focal length") between the radiating source and the electromagnetic lens. The various electromagnetic and geometric parameters (for example the typology of the radiating elements of the phase-shifting cells and of the emissive region, the surface of the electromagnetic lens, the focal length, etc.) condition the gain of the antenna and its frequency evolution. For example, at parity of the ratio F/D, where F is the focal length and D is the diameter of the electromagnetic lens, the parameter D—and therefore the parameter F—have to be doubled in order to achieve a gain of 6 dBi (decibels relative to isotropic) and keep the same relative bandwidth at 1 dB or 3 dB. The ratio F/D is typically between 0.3 and 0.7. If it is desired to maintain the ratio F/D, then it is necessary to increase F.

Such an antenna from the prior art is not entirely satisfactory in so far as the search for a high gain for the antenna will therefore lead to an increase in the focal length, and thereby the thickness of the antenna. The search for a high gain, while keeping the same relative frequency behaviour, will therefore require good control of the excitation of the phase-shifting cells over a wide aperture. However, controlling the excitation of the phase-shifting cells over a wide aperture may prove to be a complex task, in particular when the operating frequency of the antenna is of the order of around ten/one hundred GHz or of one THz, specifically because of a need for high precision of the assembly between the emissive region and the electromagnetic lens.

In addition, the control electronics for the switches will have to be positioned with care so as to interfere as little as possible with the radiation transmitted by the phase-shifting cells.

DISCLOSURE OF THE INVENTION

The invention aims to fully or partly rectify the above-mentioned drawbacks. To this end, one subject of the invention is a reconfigurable antenna, comprising:

- an emissive region, comprising at least one radiating source designed to emit electromagnetic waves;
- an electromagnetic lens, comprising:

a set of phase-shifting cells, comprising switches configured so as to introduce a phase shift to the electromagnetic waves, bias lines, designed to bias the switches;

an electromagnetic coupling region, arranged between the emissive region and the electromagnetic lens in order to generate electromagnetic coupling between the electromagnetic waves and the set of phase-shifting cells;

the electromagnetic coupling region comprises a set of electrically conductive elements, arranged so as to form a contour of a resonant cavity guiding the electromagnetic waves towards the electromagnetic lens, the set of electrically conductive elements comprising first tracks electrically connected to the bias lines.

Definitions

"Radiating source" is understood to mean any system (preferably a focal system) designed to emit electromagnetic waves.

"Electromagnetic lens" is understood to mean a transmitarray.

"Phase-shifting cell" is understood to mean an elementary cell of a transmitarray. By way of example, an elementary cell may comprise at least:

a first planar antenna (called receive antenna), designed to receive an incident wave emitted by the radiating source or sources;

a second planar antenna (called transmit antenna), designed to transmit, with a phase shift, the incident wave received by the first antenna.

Other elementary cell architectures may also be used, such as multilayer structures based on the concept of frequency-selective surfaces, or on the concept of Fabry-Perot cavities. Radiating elements such as dipoles, slots etc. may also be used in the elementary cell.

"Switches" are understood to mean elements that make it possible to authorize or prohibit the flow of an electric current, for example between two separate radiating surfaces of the transmit antenna of the phase-shifting cell.

"Bias lines" are understood to mean tracks made of an electrically conductive material.

"Electrically conductive" is understood to mean an element having an electrical conductivity at 300 K greater than $10^2$ S/cm.

"Electromagnetic coupling" is understood to mean electromagnetic field-based coupling (that is to say a transfer of energy) between the electromagnetic waves emitted by the radiating source or sources and the phase-shifting cells (more precisely with the radiating surface of the receive antenna of the phase-shifting cells).

Such an antenna according to the invention thus makes it easier to excite the phase-shifting cells over a wide aperture, when a high antenna gain is sought, by virtue of such an electromagnetic coupling region that allows near-field excitation of the phase-shifting cells. The size and shape of the resonant cavity may be adapted in order to optimize the radiation received by the phase-shifting cells, for example to homogenize the amplitude and the phase and to increase the coupling efficiency.

Using electromagnetic coupling then makes it possible notably to obtain an antenna with a reduced thickness in comparison with a slot antenna, to avoid a significant decrease in the electromagnetic field received by the phase-shifting cells located on the edges of the electromagnetic lens, or even to overcome a (frequency) dependence of the electromagnetic radiation received by the phase-shifting cells during beam depointing.

Moreover, such a resonant cavity makes it possible not to lose energy on the lateral parts of the antenna, thereby making it possible to increase the quality of the radiation transmitted by the phase-shifting cells located on the edges of the electromagnetic lens, and to control the illumination law for the electromagnetic lens (apodization or "aperture taper"). Mention may be made for example of the increase in radiation efficiency, by virtue of the reduction in "spill-over" (portion of the emitted radiation that does not reach the phase-shifting cells, a phenomenon that is present if the resonant cavity is permissive to electromagnetic waves), the reduction in the levels of the side lobes (SLL for "Side Lobe Level"), etc.

The set of electrically conductive elements, forming a contour of the resonant cavity, allows electromagnetic shielding close to the lateral parts of the transmitarray antenna.

Finally, the fact that the set of electrically conductive elements comprises first tracks electrically connected to the bias lines makes it possible to contemplate moving the control electronics for the switches (for example to under the antenna) so as to interfere as little as possible with the radiation emitted by the radiating source or sources, and the radiation transmitted by the phase-shifting cells.

The antenna according to the invention may include one or more of the following features.

According to one feature of the invention, the resonant cavity has:

a first open end, opening onto the electromagnetic lens;

an opposing second open end, opening onto the emissive region;

a lateral part, connecting the first and second open ends, the contour of which is formed by the set of electrically conductive elements.

According to one feature of the invention, the electromagnetic coupling region extends in a dielectric medium.

One advantage that is afforded is thus that of avoiding electromagnetic interference in the electromagnetic coupling region. The dielectric medium may be air.

According to one feature of the invention, the electromagnetic coupling region comprises a dielectric substrate, comprising interconnect levels; the first tracks being formed on the interconnect levels;

and the set of electrically conductive elements comprises first vias, designed to electrically connect the first tracks between the interconnect levels.

Definition

"Dielectric substrate" is understood to mean that the substrate has an electrical conductivity at 300 K of less than $10^{-8}$ S/cm.

"Via" is understood to mean a metallized hole for establishing an electrical connection between various interconnect levels.

One advantage that is afforded is thus that of contemplating integrating the resonant cavity within the dielectric substrate.

According to one feature of the invention, the set of electrically conductive elements comprises second tracks electrically connected to the bias lines.

According to one feature of the invention, the second tracks are formed on the interconnect levels;

and the set of electrically conductive elements comprises second vias, designed to electrically connect the second tracks between the interconnect levels.

According to one feature of the invention, the antenna comprises switching means configured so as to switch between the first and second tracks, the non-switched first or second tracks being at floating electrical potential.

Definition

"Floating electrical potential" is understood to mean that the non-switched tracks are not subjected to a reference electrical potential at the operating frequency of the antenna.

One advantage that is afforded is thus that of adding a degree of freedom to adjust the electromagnetic behaviour of the resonant cavity. More precisely, there is a first resonant cavity whose contour is formed by the first tracks and the first vias. Likewise, there is a second resonant cavity whose contour is formed by the second tracks and the second vias. The switching means therefore make it possible to switch between the first resonant cavity and the second resonant cavity. By way of non-limiting examples, the first resonant cavity may be configured (in terms of size and shape) so as to widen the bandwidth, while the second resonant cavity may be configured (in terms of size and shape) so as to increase the depointing range.

According to one feature of the invention, the set of electrically conductive elements is arranged such that the contour of the resonant cavity has a cross section that increases from the emissive region towards the electromagnetic lens.

Definitions

"Cross section" is understood to mean a section perpendicular to an axis corresponding to the normal to a plane defined by the electromagnetic lens.

"Increasing" is understood to mean that the area of the cross section increases from the emissive region towards the electromagnetic lens.

One advantage that is afforded by such a shape of the resonant cavity is thus that of promoting a large gain for the antenna.

According to one feature of the invention, the set of electrically conductive elements is arranged such that the contour of the resonant cavity exhibits axial symmetry.

Definition

"Axial symmetry" is understood to mean symmetry about an axis corresponding to the normal to a plane defined by the electromagnetic lens.

One advantage that is afforded by such a shape of the resonant cavity is thus that of promoting the directivity of the antenna, that is to say the ability of the antenna to concentrate the radiated energy in a solid angle or in a specific direction.

According to one feature of the invention, the emissive region is planar.

One advantage that is afforded is thus that of allowing monolithic integration of the emissive region into the resonant cavity when the resonant cavity is formed in a dielectric substrate.

According to one feature of the invention, the electromagnetic lens is planar.

One advantage that is afforded is thus that of monolithically integrating the electromagnetic lens into the resonant cavity when the resonant cavity is formed in a dielectric substrate.

According to one feature of the invention, the emissive region, the electromagnetic coupling region and the electromagnetic lens are monolithic.

Definition

"Monolithic" is understood to mean that the emissive region, the electromagnetic coupling region and the electromagnetic lens share one and the same substrate, in the sense that the emissive region, the electromagnetic coupling region and the electromagnetic lens are formed on the same substrate.

One advantage that is afforded is thus that of simplifying the manufacture of the antenna with monolithic technology, for example a PCB ("Printed Circuit Board") or LTCC ("Low Temperature Co-fired Ceramic") technology. These technologies allow monolithic implementations, with substrate thicknesses conventionally between 100 μm and 10 mm, and are very particularly suitable when the operating frequency of the antenna is between 1 GHz and 1 THz, small substrate thicknesses being suitable for frequencies of the order of one GHz, while large substrate thicknesses are suitable for frequencies of the order of one THz.

According to one feature of the invention, the resonant cavity has a thickness between $\lambda$ and $10\lambda$, where $\lambda$ is the wavelength of the electromagnetic waves.

One advantage that is afforded is thus that of obtaining a compact cavity.

Another subject of the invention is a passive antenna, comprising:

an emissive region, comprising at least one radiating source designed to emit electromagnetic waves;

an electromagnetic lens, comprising:

a set of phase-shifting cells, configured so as to introduce a phase shift to the electromagnetic waves, a ground plane;

an electromagnetic coupling region, arranged between the emissive region and the electromagnetic lens in order to generate electromagnetic coupling between the electromagnetic waves and the set of phase-shifting cells;

the electromagnetic coupling region comprises a set of electrically conductive elements, arranged so as to form a contour of a resonant cavity guiding the electromagnetic waves towards the electromagnetic lens, the set of electrically conductive elements comprising tracks electrically connected to the ground plane.

Definitions

"Passive antenna" is understood to mean that the phase-shifting cells do not have any active electronic components for introducing a phase shift to the electromagnetic waves. The phase shift may be obtained for example through different geometric configurations of the receive and transmit antennas of the phase-shifting cell.

"Ground plane" is understood to mean an electrically conductive surface, preferably made of metal, forming an electrical ground plane so as to define a reference potential for the electromagnetic waves.

Such an antenna according to the invention thus makes it easier to excite the phase-shifting cells over a wide aperture, when a high antenna gain is sought, by virtue of such an electromagnetic coupling region that allows near-field excitation of the phase-shifting cells. The size and shape of the resonant cavity may be adapted in order to optimize the radiation received by the phase-shifting cells, for example to homogenize the amplitude and the phase and to increase the coupling efficiency.

Moreover, such a resonant cavity makes it possible not to lose energy on the lateral parts of the antenna, thereby making it possible to increase the quality of the radiation transmitted by the phase-shifting cells located on the edges of the electromagnetic lens, and to control the illumination law for the electromagnetic lens (apodization or "aperture taper"). Mention may be made for example of the increase in radiation efficiency, by virtue of the reduction in "spill-over" (portion of the emitted radiation that does not reach the phase-shifting cells, a phenomenon that is present if the resonant cavity is permissive to electromagnetic waves), the reduction in the levels of the side lobes (SLL for "Side Lobe Level"), etc.

The set of electrically conductive elements, forming a contour of the resonant cavity, allows electromagnetic shielding close to the lateral parts of the transmitarray antenna.

BRIEF DESCRIPTION OF THE DRAWINGS

Other features and advantages will become apparent in the detailed description of various embodiments of the invention, the description being accompanied by examples and references to the appended drawings.

Figure 1:
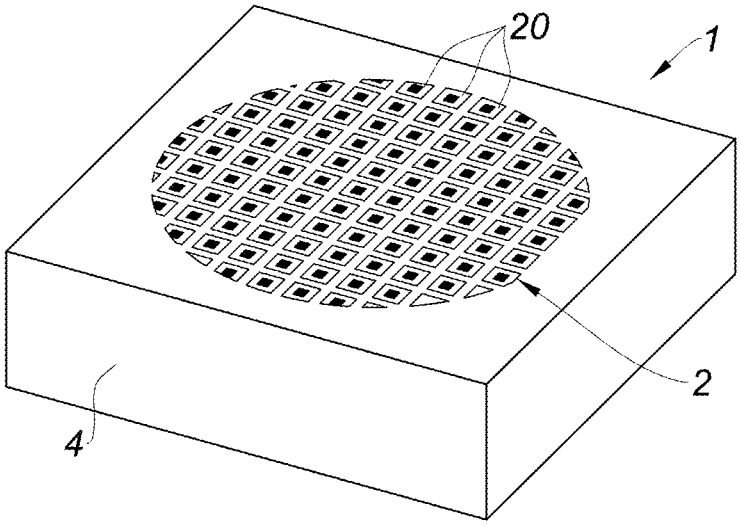
FIG. 1 is a schematic perspective view of an antenna according to the invention.
Figure 2:
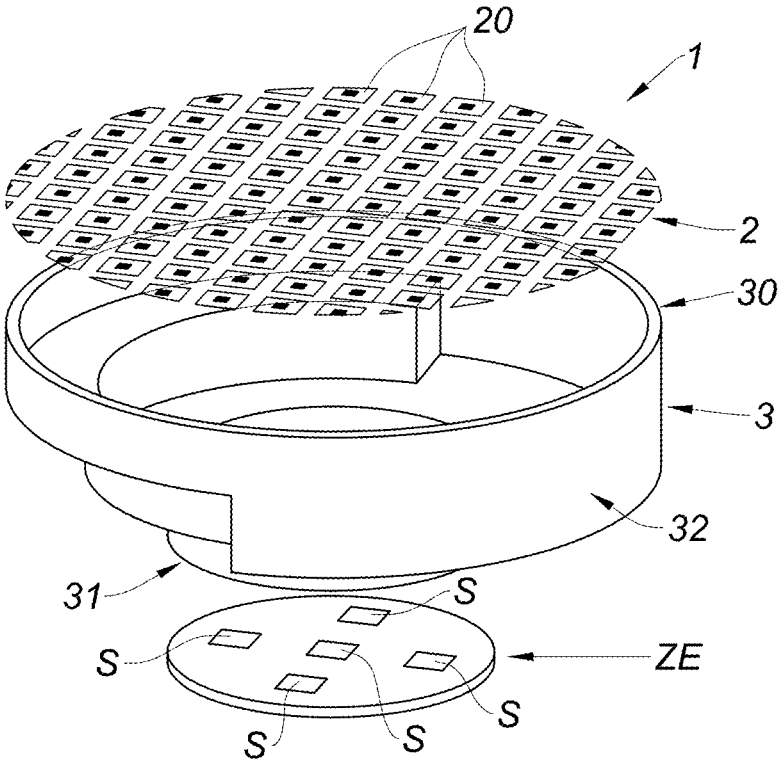
FIG. 2 is a schematic exploded perspective view of an antenna according to the invention, illustrating a first embodiment of the resonant cavity. The dielectric medium is not shown in order to facilitate viewing.
Figure 3:
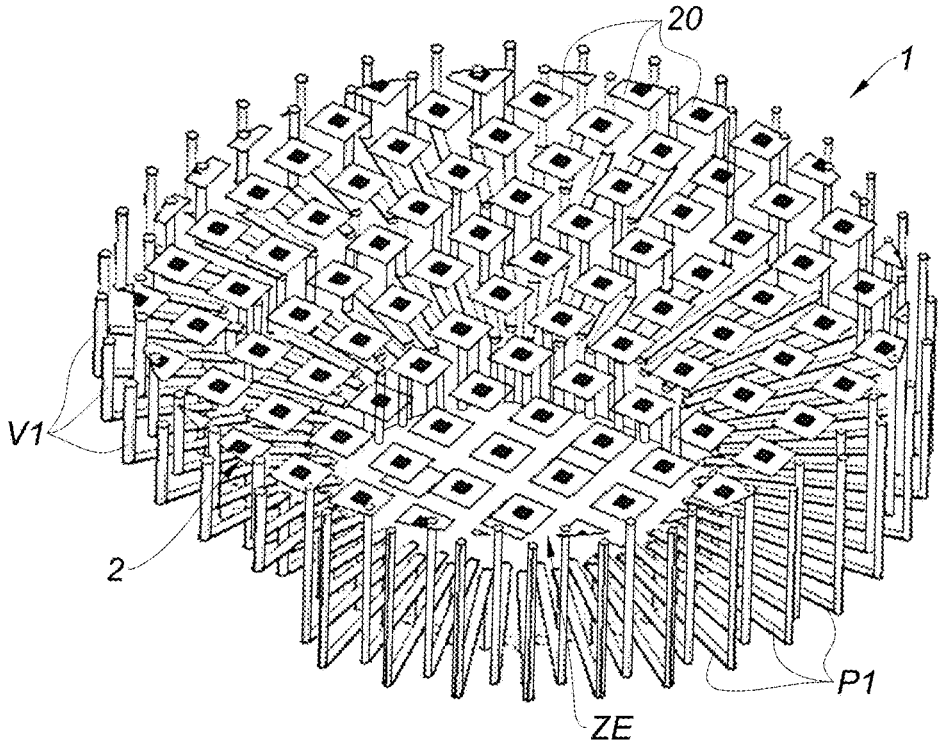
FIG. 3 is a schematic perspective view of an antenna according to the invention, illustrating a second embodiment of the resonant cavity. The dielectric medium is not shown in order to facilitate viewing.

The figures are not shown to scale for the sake of legibility and to simplify understanding thereof.

DETAILED DISCLOSURE OF THE EMBODIMENTS

For the sake of simplicity, elements that are identical or that perform the same function in the various embodiments will bear the same references.

One subject of the invention is a reconfigurable antenna 1, comprising:

an emissive region ZE, comprising at least one radiating source S designed to emit electromagnetic waves;

an electromagnetic lens 2, comprising:

a set of phase-shifting cells 20, comprising switches 200 configured so as to introduce a phase shift to the electromagnetic waves, bias lines BL, designed to bias the switches 200;

an electromagnetic coupling region ZC, arranged between the emissive region ZE and the electromagnetic lens 2 in order to generate electromagnetic coupling between the electromagnetic waves and the set of phase-shifting cells 20;

the electromagnetic coupling region ZC comprises a set of electrically conductive elements, arranged so as to form a contour of a resonant cavity 3 guiding the electromagnetic waves towards the electromagnetic lens 2, the set of electrically conductive elements comprising first tracks P1 electrically connected to the bias lines BL.

Emissive Region

The emissive region ZE is advantageously planar, such that each radiating source S is located equidistant from the electromagnetic lens 2.

The or each radiating source S is advantageously configured so as to operate at a frequency between 1 GHz and 1 THz, preferably between 10 GHz and 300 GHz.

The emissive region ZE is advantageously electrically connected to a transceiver, located at the rear of the antenna 1 or under the antenna 1.

Electromagnetic Lens

The electromagnetic lens 2 is advantageously planar.

Each phase-shifting cell 20 may comprise:

a first planar antenna (called receive antenna, not illustrated), designed to receive the incident wave emitted by the radiating source or sources S;

a second planar antenna Tx (called transmit antenna), designed to transmit, with a phase shift, the incident wave received by the first planar antenna.

Figure 4:
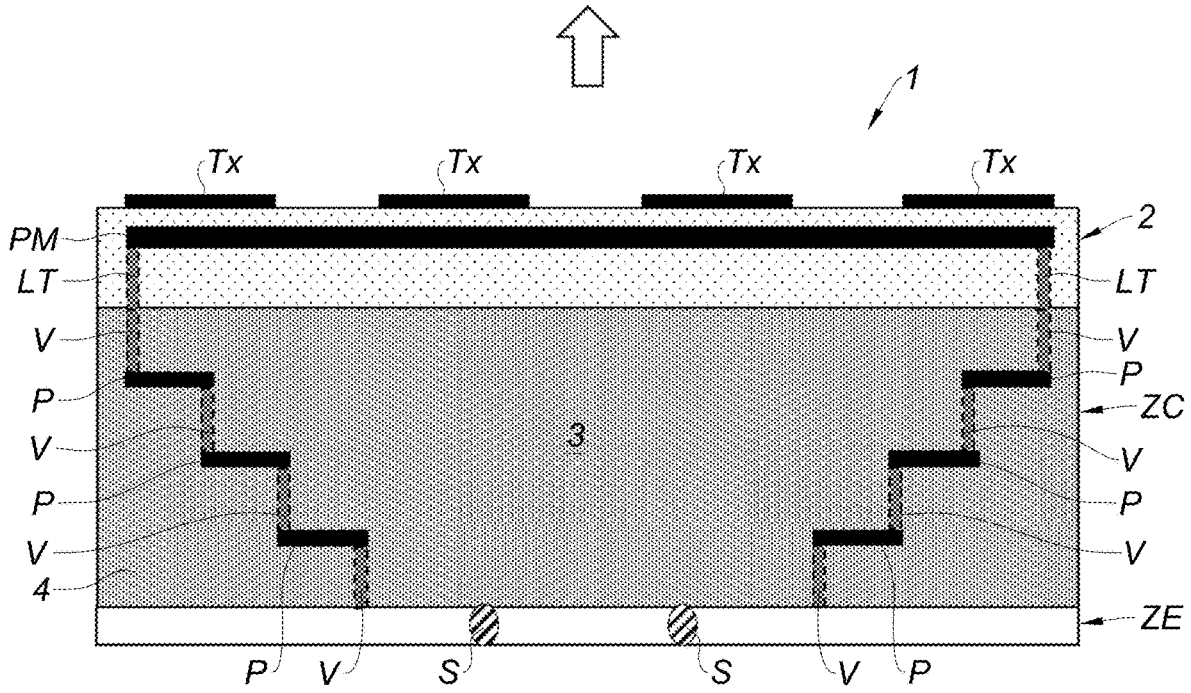
FIG. 4 is a schematic sectional view of a passive antenna according to the invention. The arrow indicates the direction of the radiation transmitted by the electromagnetic lens.
Figure 5:
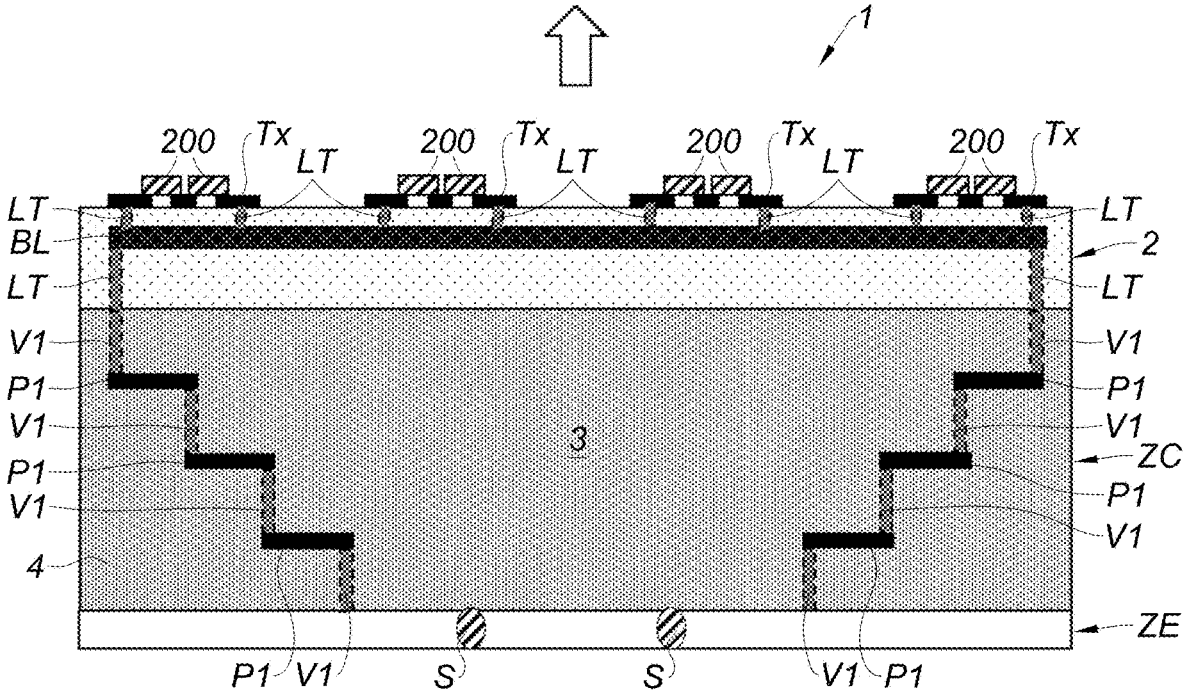
FIG. 5 is a schematic sectional view of a reconfigurable antenna according to the invention, illustrating a first shape of the resonant cavity. The arrow indicates the direction of the radiation transmitted by the electromagnetic lens.
Figure 6:
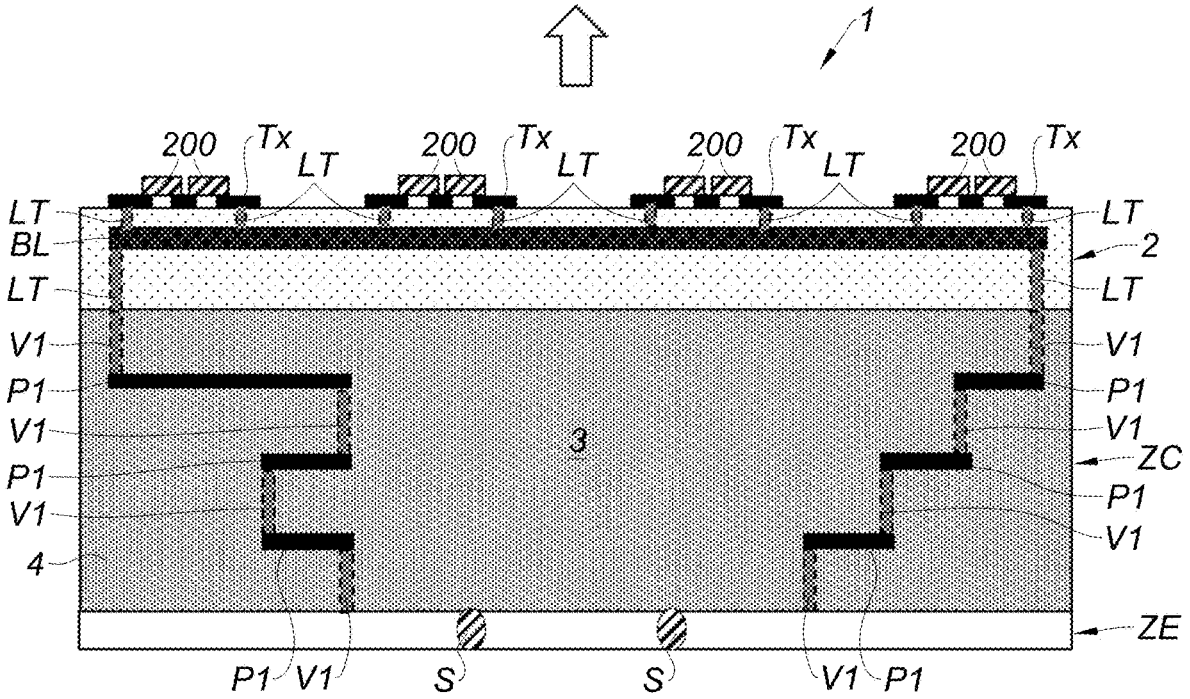
FIG. 6 is a schematic sectional view of a reconfigurable antenna according to the invention, illustrating a second shape of the resonant cavity. The arrow indicates the direction of the radiation transmitted by the electromagnetic lens.
Figure 7:
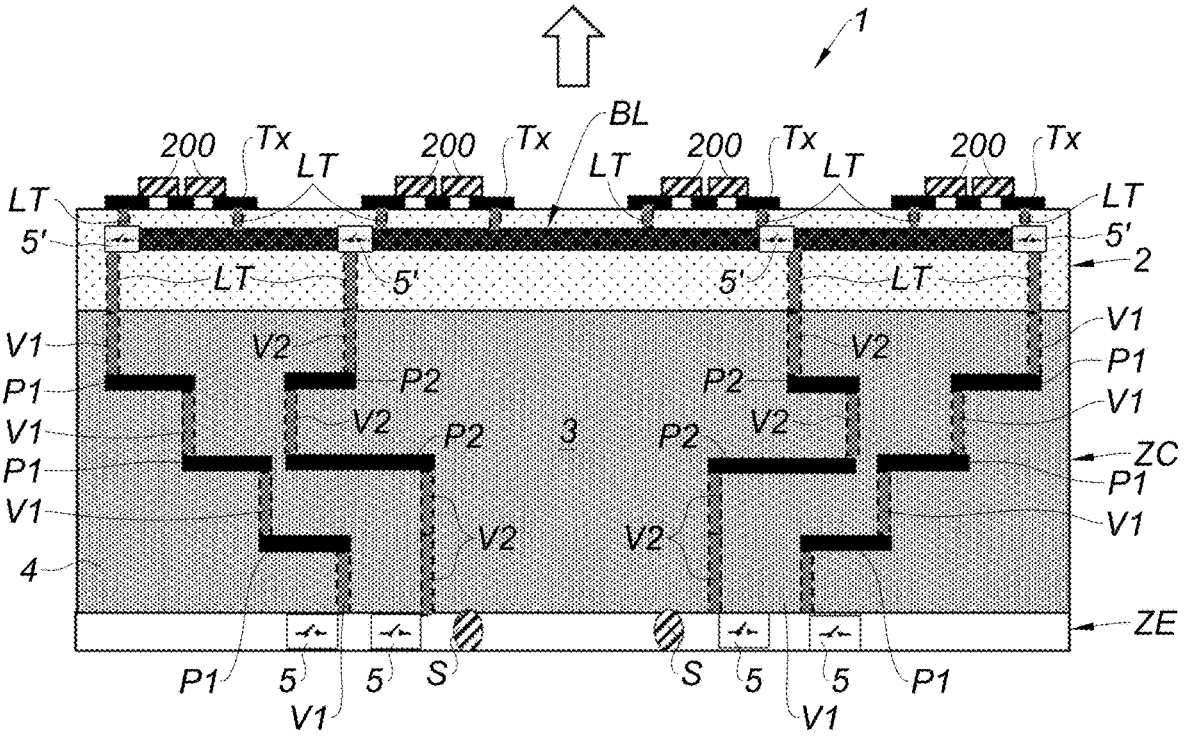
FIG. 7 is a schematic sectional view of a reconfigurable antenna according to the invention, illustrating an embodiment where it is possible to switch between a first resonant cavity and a second resonant cavity of a different shape. The arrow indicates the direction of the radiation transmitted by the electromagnetic lens.

The first planar antenna and the second planar antenna Tx are advantageously arranged on either side of a ground plane (not illustrated, except in FIG. 4 for a passive, non-reconfigurable antenna). The ground plane is preferably made of a metal material, more preferably copper. By way of non-limiting example, the ground plane may have a thickness of the order of 17 μm when the operating frequency of the transmitarray antenna is 29 GHz.

The second planar antenna Tx advantageously has first and second radiating surfaces, separate in the sense that they are separated from one another by a separating region so as to be electrically isolated from one another. To this end, a slot is advantageously formed in the second planar antenna Tx in order to electrically isolate the separate first and second radiating surfaces. The slot defines the separating region. The slot is preferably annular, with a rectangular cross section. Of course, other shapes may be contemplated for the slot, such as an elliptical or circular shape. According to one variant implementation, the first and second radiating surfaces of the second planar antenna may be electrically isolated by a dielectric material.

Each phase-shifting cell 20 advantageously comprises a phase shift circuit comprising first and second switches 200 respectively alternately having an on state and an off state, the on or off states corresponding to a respectively authorized or blocked flow of a current between the separate first and second radiating surfaces of the second planar antenna Tx. "Alternately" is understood to mean that the first switch 200 alternates between the on state and the off state, while, simultaneously, the second switch 200 alternates between the off state and the on state. In other words, at all times, the first and second switches 200 belonging to the same phase shift circuit have two opposing states, either on/off or off/on. On/on or off/off states are not authorized.

By way of non-limiting examples, the switches 200 of the phase-shifting cells 20 may be PIN diodes, MEMS ("Micro Electro-Mechanical Systems"), NEMS ("Nano Electro-Mechanical Systems"). PIN diodes may be made from AlGaAs. Other implementation forms may be contemplated for the switches 200. By way of non-limiting examples, radiofrequency switches such as diodes, transistors, photodiodes and phototransistors are possible. The choice of a device for controlling the switches 200 depends on the technology that is chosen. By way of examples, the following devices may be used:

an optical fibre for a photoelectric switch, a laser beam generated by external means and exciting a photoelectric switch, an electromagnetic wave according to the principles of remote power supply known from the field of RFID ("Radio Frequency Identification").

The bias lines BL are electrically conductive tracks, forming control means for controlling the switches 200 of the phase-shifting cells 20. The bias lines BL are preferably made from a metal material, more preferably copper. The bias lines BL may be electrically connected to the set of electrically conductive elements, and to the second planar antenna Tx, by way of transmission lines LT.

Other phase-shifting cell 20 architectures may also be used, such as multilayer structures based on the concept of frequency-selective surfaces, or on the concept of Fabry-Perot cavities.

Electromagnetic Coupling Region

The electromagnetic coupling region ZC advantageously extends in a dielectric medium.

The electromagnetic coupling region ZC advantageously comprises a dielectric substrate 4, comprising interconnect levels. By way of non-limiting example, the dielectric substrate 4 may be made of a commercial material such as RT/Duroid® 6002. The dielectric substrate 4 has a thickness typically of between 100 μm and 1500 μm for an operating frequency of the antenna of between 10 GHz and 300 GHz. By way of non-limiting example, the dielectric substrate 4 may have a thickness of the order of 4 mm when the operating frequency is 60 GHz.

The first tracks P1 are advantageously formed on the interconnect levels. The set of electrically conductive elements advantageously comprises first vias V1, designed to electrically connect the first tracks P1 between the interconnect levels.

The set of electrically conductive elements may comprise second tracks P2 electrically connected to the bias lines BL. The second tracks P2 are advantageously formed on the interconnect levels. The set of electrically conductive elements advantageously comprises second vias V2, designed to electrically connect the second tracks P2 between the interconnect levels. The antenna 1 advantageously comprises switching means 5 configured so as to switch between the first and second tracks P1, P2, the non-switched first or second tracks P1, P2 being at floating electrical potential. To this end, additional switching means 5' may be provided on the bias lines BL such that the non-switched first or second tracks P1, P2 are at floating electrical potential.

The resonant cavity 3 advantageously has:

a first open end 30, opening onto the electromagnetic lens 2;

an opposing second open end 31, opening onto the emissive region ZE;

a lateral part 32, connecting the first and second open ends 30, 31, the contour of which is formed by the set of electrically conductive elements.

The resonant cavity 3 is therefore defined by the emissive region ZE, the electromagnetic lens 2 and the set of electrically conductive elements. According to one embodiment, the resonant cavity 3 is defined by the emissive region ZE, the electromagnetic lens 2, the first tracks P1 and the first vias V1. In other words, the first tracks P1 and the first vias V1 form the contour of the lateral part 32 of the resonant cavity 3. According to another embodiment, the resonant cavity 3 is defined by the emissive region ZE, the electromagnetic lens 2, the second tracks P2 and the second vias V2. In other words, the second tracks P2 and the second vias V2 form the contour of the lateral part 32 of the resonant cavity 3.

The resonant cavity 3 advantageously has a thickness between $\lambda$ and $10\lambda$, where $\lambda$ is the wavelength of the electromagnetic waves. The size and shape of the resonant cavity 3 are defined by the template of the first and second tracks P1, P2 and of the first and second vias V1, V2. The template is determined by electromagnetic simulations according to the desired properties of the antenna 1.

According to one embodiment, the set of electrically conductive elements is arranged such that the contour of the resonant cavity 3 has a cross section that increases from the emissive region ZE towards the electromagnetic lens 2.

According to one embodiment, the set of electrically conductive elements is arranged such that the contour of the resonant cavity 3 exhibits axial symmetry.

Monolithic Integration

The emissive region ZE, the electromagnetic coupling region ZC and the electromagnetic lens 2 are advantageously monolithic, within the dielectric substrate 4.

The antenna 1 may be manufactured with a planar technology allowing a monolithic implementation, preferably selected from among:

PCB ("Printed Circuit Board") technology,

LTCC ("Low Temperature Co-fired Ceramic") technology,

WLP ("Wafer-Level Packaging") technology.

Passive Antenna (Fixed Beam)

Another subject of the invention is a passive antenna 1, comprising:

an emissive region ZE, comprising at least one radiating source S designed to emit electromagnetic waves;

an electromagnetic lens 2, comprising:

a set of phase-shifting cells 20, configured so as to introduce a phase shift to the electromagnetic waves, a ground plane PM;

an electromagnetic coupling region ZC, arranged between the emissive region ZE and the electromagnetic lens 2 in order to generate electromagnetic coupling between the electromagnetic waves and the set of phase-shifting cells 20;

the electromagnetic coupling region ZC comprises a set of electrically conductive elements, arranged so as to form a contour of a resonant cavity 3 guiding the electromagnetic waves towards the electromagnetic lens 2, the set of electrically conductive elements comprising tracks P electrically connected to the ground plane PM.

The ground plane PM is preferably made of a metal material, more preferably copper. By way of non-limiting example, the ground plane PM may have a thickness of the order of 17 μm when the operating frequency of the transmitarray antenna is 29 GHz.

Each phase-shifting cell 20 may comprise:

a first planar antenna (called receive antenna, not illustrated), designed to receive the incident wave emitted by the radiating source or sources S;

a second planar antenna Tx (called transmit antenna), designed to transmit, with a phase shift, the incident wave received by the first planar antenna.

Other phase-shifting cell 20 architectures may also be used, such as multilayer structures based on the concept of frequency-selective surfaces, or on the concept of Fabry-Perot cavities.

The first planar antenna and the second planar antenna Tx are arranged on either side of the ground plane PM. The ground plane PM may be electrically connected to the set of electrically conductive elements by way of transmission lines LT.

The electromagnetic coupling region ZC advantageously comprises a dielectric substrate 4, comprising interconnect levels. The tracks P are advantageously formed on the interconnect levels. The set of electrically conductive elements advantageously comprises vias V, designed to electrically connect the tracks P between the interconnect levels.

The resonant cavity 3 advantageously has:

a first open end 30, opening onto the electromagnetic lens 2;

an opposing second open end 31, opening onto the emissive region ZE;

a lateral part 32, connecting the first and second open ends 30, 31, the contour of which is formed by the set of electrically conductive elements.

The resonant cavity 3 advantageously has a thickness between λ and 10λ, where λ is the wavelength of the electromagnetic waves.

The invention is not limited to the described embodiments. A person skilled in the art has the ability to consider technically operative combinations thereof and to substitute them for equivalents.

The invention claimed is:

1. A reconfigurable antenna, comprising:

an emissive region including at least one radiating source configured to emit electromagnetic waves;

an electromagnetic lens, including a set of phase-shifting cells, including switches configured to introduce a phase shift to the electromagnetic waves, and bias lines, configured to bias the switches; and an electromagnetic coupling region, arranged between the emissive region and the electromagnetic lens in order to generate electromagnetic coupling between the electromagnetic waves and the set of phase-shifting cells, wherein the electromagnetic coupling region comprises a set of electrically conductive elements, arranged to form a contour of a lateral part of a resonant cavity guiding the electromagnetic waves towards the electromagnetic lens, the set of electrically conductive elements including first tracks electrically connected to the bias lines; and the lateral part of the resonant cavity, which extends from the emissive region to the electromagnetic lens, connects a first open end and an opposing second open end of the resonant cavity.

2. The reconfigurable antenna according to claim 1, wherein the resonant cavity further comprises:

the first open end, opening onto the electromagnetic lens; and the opposing second open end, opening onto the emissive region.

3. The reconfigurable antenna according to claim 1, wherein the electromagnetic coupling region extends in a dielectric medium.

4. The reconfigurable antenna according to claim 1, wherein the electromagnetic coupling region further comprises a dielectric substrate including interconnect levels, the first tracks being formed on the interconnect levels; and the set of electrically conductive elements includes first vias, configured to electrically connect the first tracks between the interconnect levels.

5. The reconfigurable antenna according to claim 1, wherein the set of electrically conductive elements comprises second tracks electrically connected to the bias lines.

6. The reconfigurable antenna according to claim 4, wherein the set of electrically conductive elements comprises second tracks electrically connected to the bias lines, the second tracks being formed on the interconnect levels; and the set of electrically conductive elements includes second vias configured to electrically connect the second tracks between the interconnect levels.

7. The reconfigurable antenna according to claim 5, further comprising switching elements configured to switch between the first and second tracks, the non-switched first or second tracks being at a floating electrical potential.

8. The reconfigurable antenna according to claim 1, wherein the set of electrically conductive elements is arranged such that the contour of the resonant cavity has a cross section that increases from the emissive region towards the electromagnetic lens.

9. The reconfigurable antenna according to claim 1, wherein the set of electrically conductive elements is arranged such that the contour of the resonant cavity exhibits axial symmetry.

10. The reconfigurable antenna according to claim 1, wherein the emissive region is planar.

11. The reconfigurable antenna according to claim 1, wherein the electromagnetic lens is planar.

12. The reconfigurable antenna according to claim 1, wherein the emissive region, the electromagnetic coupling region, and the electromagnetic lens are monolithic.

13. The reconfigurable antenna according to claim 1, wherein the resonant cavity has a thickness between λ and 10λ, where λ is a wavelength of the electromagnetic waves.

14. A passive antenna, comprising:

an emissive region, including at least one radiating source configured to emit electromagnetic waves;

an electromagnetic lens, including a set of phase-shifting cells configured to introduce a phase shift to the electromagnetic waves, and a ground plane; and an electromagnetic coupling region, arranged between the emissive region and the electromagnetic lens in order to generate electromagnetic coupling between the electromagnetic waves and the set of phase-shifting cells, wherein the electromagnetic coupling region comprises a set of electrically conductive elements, arranged to form a contour of a lateral part of a resonant cavity guiding the electromagnetic waves towards the electromagnetic lens, the set of electrically conductive elements including tracks electrically connected to the ground plane; and the lateral part of the resonant cavity, which extends from the emissive region to the electromagnetic lens, connects a first open end and an opposing second open end of the resonant cavity.

15. A reconfigurable antenna, comprising:

an emissive region including at least one radiating source configured to emit electromagnetic waves;

an electromagnetic lens, including a set of phase-shifting cells, including switches configured to introduce a phase shift to the electromagnetic waves, and bias lines, configured to bias the switches; and an electromagnetic coupling region, arranged between the emissive region and the electromagnetic lens in order to generate electromagnetic coupling between the electromagnetic waves and the set of phase-shifting cells, wherein the electromagnetic coupling region comprises a set of electrically conductive elements, arranged to form a contour of a resonant cavity guiding the electromagnetic waves towards the electromagnetic lens, the set of electrically conductive elements including first tracks electrically connected to the bias lines;

the set of electrically conductive elements comprises second tracks electrically connected to the bias lines; and the antenna further comprises switching elements configured to switch between the first and second tracks, the non-switched first or second tracks being at a floating electrical potential.

* * * * *